US006761497B2

(12) United States Patent
Kaneda

(10) Patent No.: US 6,761,497 B2
(45) Date of Patent: Jul. 13, 2004

(54) LOOSE-LEAF BINDER

(76) Inventor: Kokki Kaneda, 9-15, Chuo 2-chome, Ota-ku, Tokyo (JP)

( * ) Notice: Subject to any disclaimer, the term of this patent is extended or adjusted under 35 U.S.C. 154(b) by 144 days.

(21) Appl. No.: 10/138,975

(22) Filed: May 3, 2002

(65) Prior Publication Data

US 2003/0206765 A1 Nov. 6, 2003

(51) Int. Cl.[7] ..... B42F 3/04

(52) U.S. Cl. ..... 402/31; 402/5; 402/19; 402/26; 402/70; 402/80 R; 402/502; D19/26

(58) Field of Search ..... 402/5, 19, 20, 402/26, 31, 36, 37, 39, 40, 70, 73, 80 R, 500, 502; D19/26, 27; 24/67 R, 67.3, 67 P, 67.5

(56) References Cited

U.S. PATENT DOCUMENTS 1,119,786 A * 12/1914 Morden et al. ..... 402/39
1,194,684 A * 8/1916 Trussell ..... 402/39
1,515,710 A * 11/1924 Trussell ..... 402/39
1,859,237 A * 5/1932 Dawson ..... 402/37
2,088,431 A * 7/1937 Newman ..... 402/39
4,522,526 A * 6/1985 Lozfau et al. ..... 402/37
6,270,280 B1 * 8/2001 Baumann ..... 402/39
D450,085 S * 11/2001 Kaneda ..... D19/32
D451,954 S * 12/2001 Kaneda ..... D19/27
D451,956 S * 12/2001 Kaneda ..... D19/32
2003/0206765 A1 * 11/2003 Kaneda ..... 402/31

* cited by examiner

*Primary Examiner*—Monica S. Carter
(74) *Attorney, Agent, or Firm*—Marshall, Gerstein & Borun LLP

(57) ABSTRACT

For ring binders of externally fitted types it is an essential requirement that they do not interfere with the turning of loose leaves. Conventional binders have had too broad backbone plates supporting binder rings to permit smooth turning of the leaves.

The invention provides a loose-leaf binder a loose-leaf binder comprising an elongate first backbone plate having a plurality of first binder half-rings formed at given intervals upright along its outer edge, and a second backbone plate having a plurality of second binder half-rings formed at given intervals upright along its edge opposite to that of the first backbone plate. The first and second backbone plates are adapted to be combined to close the first and second half-rings to form complete binder rings. The first backbone plate has a plurality of through-holes formed at given intervals in the longitudinal direction of the binder, across the length of the binder, and also has a plurality of engaging recesses formed in the outer edge surface on the side of the first half-rings. The second backbone plate has a plurality of pins that fit in the through-holes and a plurality of protuberances adapted to fit in the recesses in the position where the binder half-rings are closed together.

11 Claims, 4 Drawing Sheets

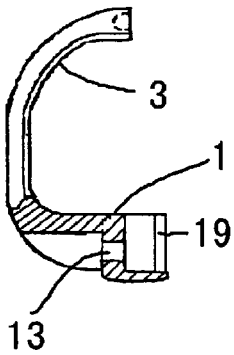
FIG. 4(a)
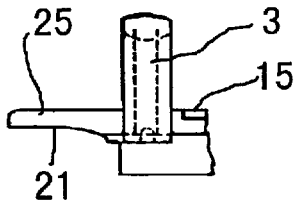
FIG. 4(b)
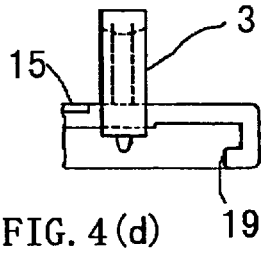
FIG. 4(d)
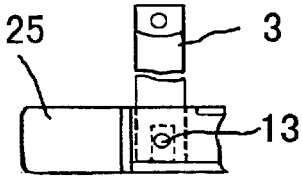
FIG. 4(c)
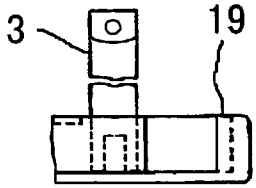
FIG. 4(e)
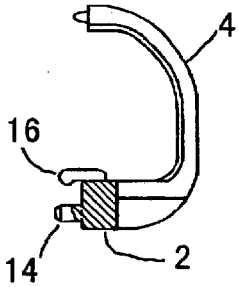
FIG. 5(a)
FIG. 5(b)
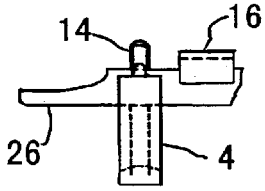
FIG. 5(d)
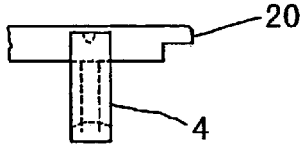
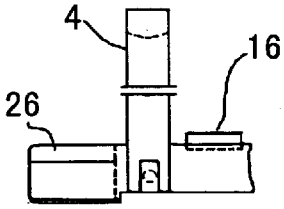
FIG. 5(c)
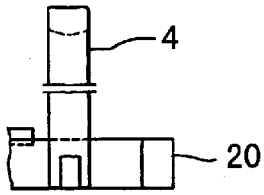
FIG. 5(e)

LOOSE-LEAF BINDER

DETAILED DESCRIPTION OF THE INVENTION

1. Field of the Invention

This invention relates to a binder for binding loose leaves having perforations in a line along one edge each for the binding purpose, and more particularly to a binder for loose-leaf album, notebook, a bundle of clear-film storage pouches or the like.

2. Prior Art

Binders of the structure having a line of two-piece binder rings that are opened and closed to hold loose leaves together are roughly divided into two types. One is called an externally fitted type which simply holds a number of loose leaves with a suitable binder having binder rings. The other is called an internally fitted type which comprises a binder holding loose leaves and a hard cover whose inner side has a plurality of eyelets or tacks with which to secure the binder in place.

Typical of the externally fitted type are one using a coiled spring binder inserted spirally into a number of tiny holes formed at regular intervals along one edge of a bundle of loose leaves and one using a binder with discrete, partly open or almost complete rings.

A similar externally fitted type binder free to open or close for easy replenishment of loose leaves has been proposed as Japanese Utility Model Registration No. 3001068. That loose-leaf binder comprises a first backbone plate and a second backbone plate. The first backbone plate is composed of an insertion plate and a plurality of first binder half-rings formed at given intervals along the outer edge of the insertion plate. The second backbone plate is composed of an upper plate and a lower plate both of which form a side wall having a plurality of second binder half-rings upright at given intervals along the outer edge opposite to the outer edge of the first backbone plate and, along with the side wall, a flat groove in which the insertion plate is closely fitted.

The first and second backbone plates are made as separate members capable of being freely engaged and disengaged. The front ends of the insertion plate and of the upper and lower plates that face one another are all so shaped as to form a circular cross section when the first and second backbone plates are engaged in the closed position. The first and second backbone plates have therebetween at least one means with which they can be engaged or disengaged so as to restrict the deviation of the binder half-rings from the direction in which they are abutted at the time the backbone plates are disengaged in the closed position. In addition, guide ribs and grooves are provided across the backbone plates to bring the binder half-rings of the two plates in alignment.

Problems that the Invention is to Solve

The externally fitted type ring binders are required to provide no obstacle to the turning of loose leaves. However, even the binder of the above-mentioned utility model registration presents difficulties. The reference binder depends on the intimate fitting of the insertion plate and the flat groove of the backbone plates for its intimate closure. The closing force thus obtained is strong enough to align the binder rings and maintain the rings in the aligned state satisfactorily, but there must be allowances for forming the insertion plate and flat groove and therefore the backbone plates cannot be reduced in width beyond certain limits. To be more concrete, about 8 mm is the minimum and if the backbone plates are narrower than that they cannot be engaged firmly together and they become too flexible to fit the insertion plate insecurely into the groove. The reference binder has another problem that, when the two backbone plates are to be closed together, the user has to fit the insertion plate into the flat groove and then fit the guide rib into the guide groove. Thus the backbone plates are not readily engaged or disengaged. Further, the lack of handhold renders it difficult to disengage the backbone plates and release the two-piece binder rings open.

This invention aims at solving these problems.

Means of Solving the Problems

To achieve the aim, the present invention provides a loose-leaf binder of the externally fitted type with the following construction.

In brief, the invention resides in a loose-leaf binder comprising an elongate first backbone plate having a plurality of first binder half-rings formed at given intervals upright along the outer edge thereof, and a second backbone plate having a plurality of second binder half-rings formed at given intervals upright along the edge thereof opposite to that of the first backbone plate, said first and second backbone plates being adapted to be combined to close the first and second half-rings to form complete binder rings, said first backbone plate having a plurality of through-holes formed at given intervals in the longitudinal direction of the binder, across the length thereof, and also having a plurality of engaging recesses formed in the outer edge surface on the side of said first half-rings, said second backbone plate having a plurality of pins that fit in said through-holes and a plurality of protuberances adapted to fit in said recesses in the position where said binder half-rings are closed together. With the construction described, the backbone plates may be made narrower than 8 mm, down to about 3 mm in the extreme cases, to ensure the positive pin-through-hole combination of the two backbone plates. Not only guiding and exact abutment of the half-rings to form binder rings are made possible but also the assembling and releasing of the two backbone plates are facilitated because of limited area of frictional contact between the backbone plates. In addition, the engagement of recesses with corresponding protuberances ensures fixing of the backbone plates firm closure of the binder rings to prevent unwanted release of the loose leaves.

Desirably, the first backbone plate has in its lower part a bottom plate portion with a horizontal upper surface, and the second backbone plate has a bottom surface that comes in contact with the upper surface of the bottom plate portion. When the two backbone plates are assembled together, the bottom surface of the second backbone plate is first placed on the upper surface of the bottom plate portion to facilitate the combination of the two backbone plates.

Preferably, the first and second binder half-rings have added thickness at the bases where they are attached to the first and second backbone plates in the plane perpendicular to the longitudinal direction of the binder. This reinforces the backbone plates that are slim and accordingly reduced in strength and also reinforces the binder rings.

In another desirable aspect of the invention, either the first or second backbone plate has at its one end a hook-shaped positioning projection extending across the backbone plate, and the other backbone plate has a tip adapted to engage the positioning projection. The arrangement permits easy vertical positioning of the backbone plates at the time of assembling. Alternatively, either the first or second backbone plate has at its one end a pivot for pivotally connecting the two plates.

In a further desirable aspect, either the first or second backbone plate is cut out on the inner side of its other end where the two backbone plates face each other to provide an opening large enough to admit therein means of releasing the binder rings or combined binder half-rings. Thus, when the combined binder half-rings are to be turned open, a coil or other similar means is put into the recess formed by the cutout portion to open the opposite ends of the backbone plates and then the engaging protuberances are pulled off, in succession, from the recesses, until the two backbone plates are put away from each other and the binder half-rings are set apart.

BRIEF EXPLANATION OF THE DRAWINGS

FIG. 4 Shows, in fractions, the left-hand member of the binder, (a) being a fragmentary sectional view corresponding to FIG. 2, (b) a plan view of the left end part, (c) a front view of the left end part, (d) a plan view of the right end part, and (e) a front view of the right end part;

FIG. 5 Shows, in fractions, the right-hand member of the binder, (a) being a fragmentary sectional view corresponding to FIG. 2, (b) a plan view of the left end part, (c) a front view of the left end part, (d) a plan view of the right end part, and (e) a front view of the right end part.

WORKING EXAMPLES

Figure 1:
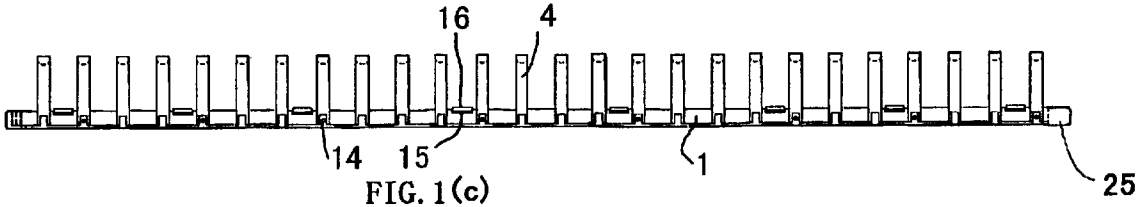
FIG. 1 Shows the general construction of a loose-leaf binder embodying the present invention, (a) being a front view, (b) a plan view, (c) a rear view, (d) a bottom view, (e) a left side view, and (f) a right side view.
Figure 1:
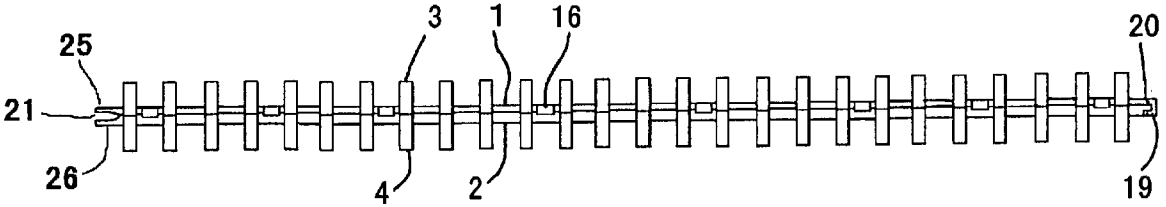
Figure 1:
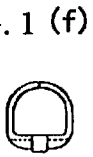
Figure 1:
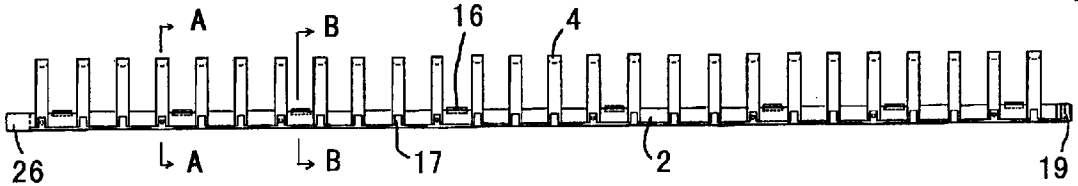
Figure 1:
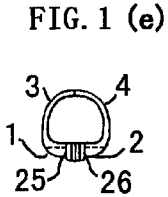
Figure 1:
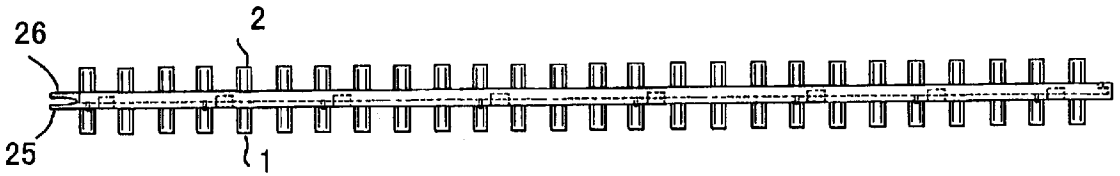
Figure 2:
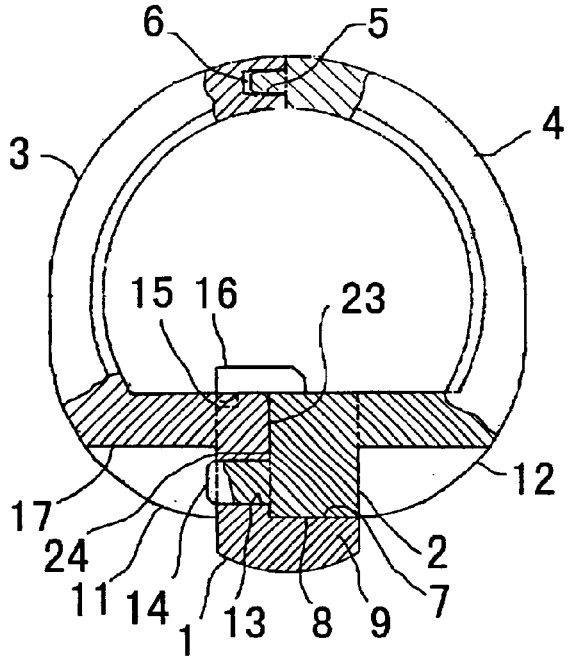
FIG. 2 Is a fragmentary sectional view, on an enlarged scale, taken along the line A—A in FIG. 1(*a*)
Figure 3:
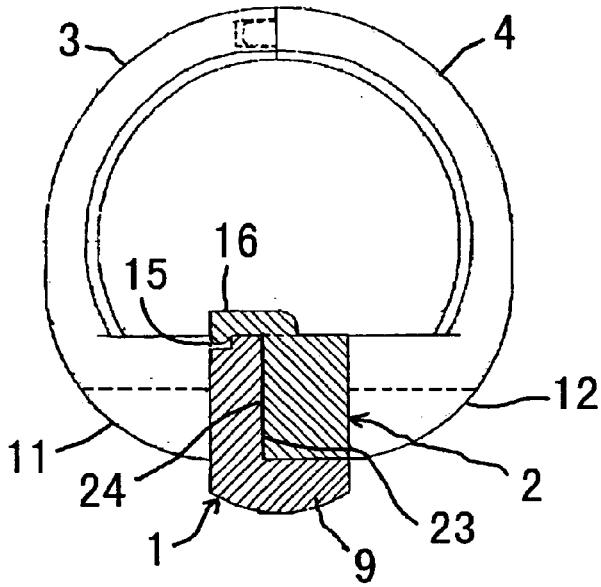
FIG. 3 is a fragmentary sectional view, on an enlarged scale, taken along the line B—B in FIG. 1(*a*)

As a preferred embodiment of the present invention, a loose-leaf binder especially suited for outside fitting (to be fitted as exposed to the outside of the front cover rather than to the inside of the cover) will now be described in detail with reference to FIG. 1 and other figures of the accompanying drawings. FIG. 1 shows the entire structure of a binder of the invention made of a plastic material such as polypropylene or ABS having both rigidity and adequate toughness to be not readily broken by externally applied forces and fabricated by injection molding into two component parts. In the drawing, (a) is a front view, (b) a plan view, (c) a rear view, (d) a bottom view, (e) a left side view, and (f) a right side view. FIG. 2 is a fragmentary sectional view, on an enlarged scale, taken along the line A—A in FIG. 1(*a*), and FIG. 3 is a fragmentary sectional view, on an enlarged scale, taken along the line B—B in FIG. 1(*a*). FIG. 4 shows the details of the left-hand member of the binder, and FIG. 5 shows the details of the right-hand member of the binder.

The binder comprises a left hand member consisting of an elongate first backbone plate 1 upon which a plurality of first half-rings 3 are set upright at given intervals along the outer edge of the plate and a right hand member consisting of a second backbone plate 2 upon which a plurality of second half-rings 4 are set upright at given intervals along the outer edge opposite to that of the first backbone plate 1. It is a loose-leaf binder in which the both backbone plates of the left and right hand members are combined to close the first half-rings 3 and second half-rings 4 together into a line of rings. When combined together, the first and second backbone plates 1, 2 form a backbone substantially rectangular shaped and extending longitudinally. As illustrated in FIGS. 2 and 3, the first half-rings 3 and the second half-rings 4 are formed, respectively, with a tiny hole 5 and a tiny protuberance 6 each, which are adapted to be engaged to align the rings and prevent the escape of the loose leaves.

The first backbone plate 1 has a bottom part 9 formed with a horizontal upper surface 7, and the second backbone plate 2 has a lower surface 8 that comes in contact with the upper surface of the bottom part 9. As shown in FIGS. 2 to 4, the first backbone plate 1 has a substantially L-shaped cross section throughout its entire length and, as shown in FIGS. 2, 3, and 5, the second backbone plate 2 has a substantially rectangular cross section along its length. These configurations allow the first backbone plate 1 and the second backbone plate 2 to be combined, with their upper surface 7 and the lower surface 8 to serve as guide faces to slide with respect to each other, so as to ensure the alignment of the two members and of the rows of their binding rings.

The first half-rings 3 and the second half-rings 4 are thickened at their bases 11, 12 where they are attached, respectively, to the first and second backbone plates 1, 2, in the planar directions perpendicular to the longitudinal direction of the binder. In the present invention the backbone plates 1, 2 are thin and flexible, and therefore the thickened bases are made rigid enough to reinforce the backbone plates 1, 2 and also add strength to the binding rings 3, 4.

As in FIGS. 2 and 4, the first backbone plate 1 has a plurality of through-holes 13 formed at given intervals across the longitudinal direction of the binder and, as in FIGS. 2 and 5, the second backbone plate 2 has a plurality of pins 14 adapted to fit in the corresponding through-holes 13. These through-holes 13 and pins 14 ensure precise positioning of the binder half-rings 3, 4 longitudinally of the two backbone plates at the time of assembling. The through-holes 13, formed in localized recesses 17 in the lower portion of a thick-walled base common to the binder half-rings 3, have no possibility of reducing the strength of the backbone plate 1.

The first backbone plate 1 has a plurality of engaging recesses 15 formed at given intervals in the upper surface on one outer edge of the first half-rings (each in the center between two adjoining half-rings as shown) in the longitudinal direction of the binder. The second backbone plate 2 has engaging protuberances 16 adapted to fit in the recesses 15 when the binder half-rings 3 and 4 are in the closed position. The engaging protuberances 16 have a rounded head each. The protuberances 16 serve as lock means to hold the both backbone plates 1, 2 in the interlocked state, but are so designed that they easily come off the recesses when the backbone plates are pulled apart horizontally as viewed in FIGS. 2 and 3 for disengagement with forces greater than a predetermined level.

As FIGS. 4 and 5 indicate, the right end of the first backbone plate 1 is formed with a hook-like positioning projection 19 extending across the backbone plate as a means to align the two backbone plates 1, 2 initially at the time of assembling. The right end of the second backbone plate 2 is correspondingly formed with a tip 20 adapted to be received by and engaged with the recess of the hook-like positioning projection 19.

As in FIGS. 4 and 5, the left ends 25, 26 of the first and second backbone plates 1, 2 are partly cut out at 21 between the opposing inner surfaces to provide a sufficient space for the insertion of some means to release the ring halves, e.g., a coin. The arrangement allows initial disengagement of the backbone plates 1, 2 in the directions away from each other when the binder rings are to be set apart.

Operation

Now the operation of the binder according to the present invention will be explained. The binder is assembled by first combining the separate backbone plates 1, 2.

To begin with, one or more loose leaves are hooked on, with their perforations along one edge, to the row of the first half-rings 3 or the fourth half-rings 4. Next, the tip 20 of the second backbone plate 2 is fitted in the recess of the hook-shaped positioning projection 19 at the right end of the first backbone plate 1, whereby the both backbone plates are aligned lengthwise. Following this, the lower surface 8 of the second backbone plate 2 is put on the upper surface of the bottom part 9 of the first backbone plate 1, and the lower surface is allowed to slide so that the two backbone plates approach each other horizontally as viewed in FIGS. 2 and 3, until the pin 14 fits in the through-hole 13. In that state the two backbone plates are put together for closure, when the free ends of the half-rings 3, 4 are abutted. Further application of pressure causes the engaging protuberances to fit resiliently into the recesses 15. Referring to FIGS. 2 and 3, the two half-rings 3, 4 are positioned, in the longitudinal direction of the binder by the through-hole 13 and the pin 14; vertically by the combinations of the through-hole 13 and the pin 14 and of the upper surface 7 and the lower surface 8; and horizontally by the combinations of the vertical inner surface 23 of the first backbone plate 1 and the vertical inner surface 24 of the second backbone plate 2 and of the engaging recess 15 and the protuberance 16.

When it becomes necessary to replace or replenish the loose leaves, the two backbone plates 1, 2 are disengaged at their left ends 25, 26 utilizing the opening 21. This allows the protuberance 16 that is the closest to the opening 21 to come off from the recess 15. The left end portions 25, 26 are then held by fingers of the both hands to force them farther apart to disengage the following protuberances in succession frontward (or leftward as viewed in FIGS. 1(*a*)–(*d*)).

Figure 6:
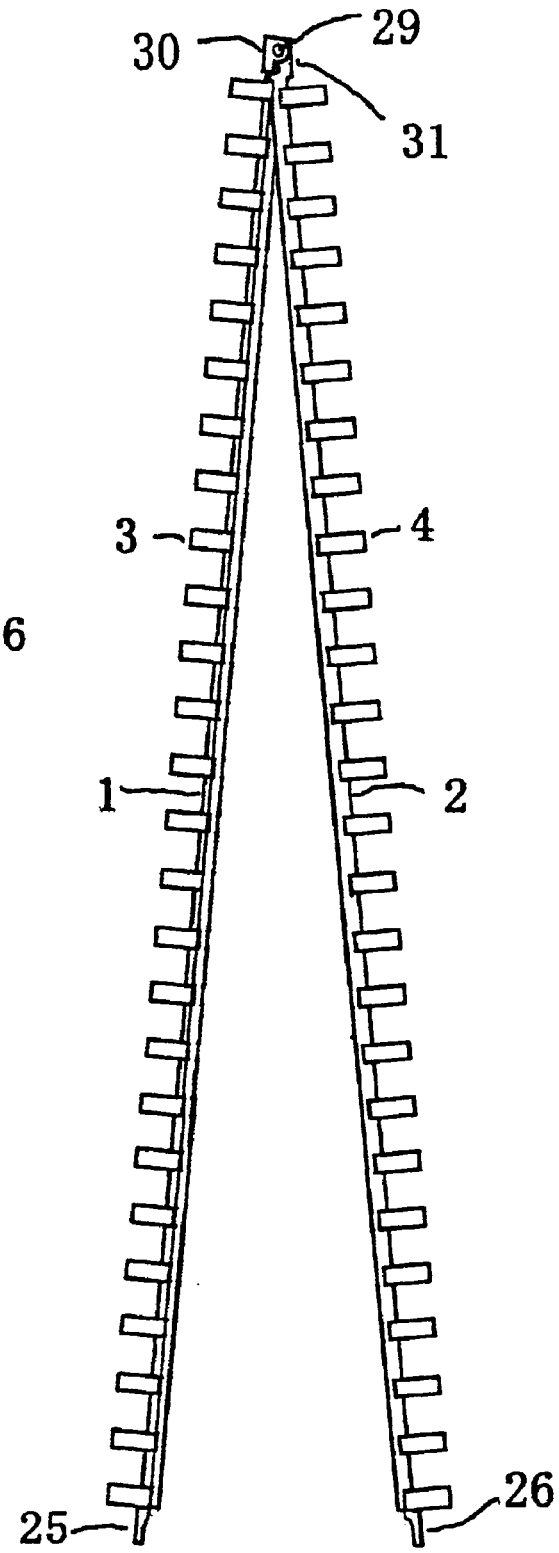
FIG. 6 Is a plan view of another embodiment of the binder in an open state.

FIG. 6 is a plan view of another embodiment of the binder of the invention in the open state. One end 30 of the first backbone plate 1 and one end 31 of the second backbone plate 2 are pivotally connected by means of a pivot 29. The remainder of the construction is the same as that of the embodiment shown in FIGS. 1 to 5. In this embodiment the two backbone plates 1, 2 can be disengaged and engaged with the pivot 29 in the center.

Effects of the Invention

As has been described above, the present invention provides a loose-leaf binder having structurally a very slim backbone which does not interfere with turning of or writing on the leaves and having binder rings which can be closed easily and precisely and, moreover, are capable of positively maintaining the state. When the rings are to be released open into constituent half-rings, limited frictional surface area makes it possible to disengage the two backbone plates readily from each other by simply removing the protuberances from their engaging recesses.

When the backbone plates are to be shut together, the hook-like positioning projection is used to align the plates longitudinally with ease. The two plates can be closed readily by means of their upper and lower sliding surfaces and the pin-through-hole combination. When the two backbone plates are to be disengaged and the rings separated into half-rings, the opening formed between the same ends of the plates permits easy removal of the adjacent protuberance from its engaging recess and thence easy separation of the two plates. This is an advantageous effect of the positioning means consisting of pins and pin-receiving holes adopted under the invention in place of conventionally inserting a flat plate into a flat groove.

What is claimed is:

1. A loose-leaf binder comprising an elongate first backbone plate having a plurality of first binder half-rings formed at given intervals upright along a first outer edge thereof, and a second backbone plate having a plurality of second binder half-rings formed at given intervals upright along a second outer edge thereof opposite to that of the first backbone plate, said first and second backbone plates being adapted to be combined to close the first and second half-rings to form complete binder rings, said first backbone plate having a plurality of through-holes formed at given intervals in the longitudinal direction of the binder, across first backbone plate, and also having a plurality of engaging recesses formed in the second outer edge of said first half-rings, said second backbone plate having a plurality of pins that fit in said through-holes and a plurality of protuberances adapted to fit in said recesses in a position where said binder half-rings are closed together.

2. A loose-leaf binder according to claim 1, wherein said first backbone plate has in the lower part thereof a bottom plate portion with a horizontal upper surface, and said second backbone plate has a bottom surface that comes in contact with the horizontal upper surface of said bottom plate portion.

3. A loose-leaf binder according to claim 1, wherein said first and second binder half-rings have added thickness at bases where they are attached to said first and second backbone plates in a plane perpendicular to the longitudinal direction of the binder.

4. A loose-leaf binder according to claim 1, wherein either said first or second backbone plate has at one end thereof a hook-shaped positioning projection extending across said backbone plate, and the other backbone plate has a tip adapted to engage said positioning projection.

5. A loose-leaf binder according to claim 1, wherein either said first or second backbone plate has at one end thereof a pivot for pivotally connecting said two plates.

6. A loose-leaf binder according to claim 1, wherein either said first or second backbone plate is cut out on an inner side of one end thereof where the two backbone plates face each other to provide an opening large enough to admit therein means of releasing the binder half-rings.

7. A loose-leaf binder according to claim 3, wherein either said first or second backbone plate has at one end thereof a hook-shaped positioning projection extending across said backbone plate, and the other backbone plate has a tip adapted to engage said positioning projection.

8. A loose-leaf binder according to claim 3, wherein either said first or second backbone plate has at one end thereof a pivot for pivotally connecting said two plates.

9. A loose-leaf binder according to claim 3, wherein either said first or second backbone plate is cut out on an inner side of the other end thereof where the two backbone plates face each other to provide an opening large enough to admit therein means of releasing the binder rings or combined binder half-rings.

10. A loose-leaf binder according to claim 4, wherein either said first or second backbone plate is cut out on an inner side of the other end thereof where the two backbone plates face each other to provide an opening large enough to admit therein means of releasing the binder rings or combined binder half-rings.

11. A loose-leaf binder according to claim 5, wherein either said first or second backbone plate is cut out on an inner side of the other end thereof where the two backbone plates face each other to provide an opening large enough to admit therein means of releasing the binder rings or combined binder half-rings.

* * * * *

UNITED STATES PATENT AND TRADEMARK OFFICE

CERTIFICATE OF CORRECTION

PATENT NO. : 6,761,497 B2
DATED : July 13, 2004
INVENTOR(S) : Kokki Kaneda

It is certified that error appears in the above-identified patent and that said Letters Patent is hereby corrected as shown below:

Title page,
Insert Item -- [30] Foreign Application Priority Data
March 23, 2001 (JP) 2001-84747 --.

Signed and Sealed this

Sixth Day of September, 2005

JON W. DUDAS
*Director of the United States Patent and Trademark Office*